US006446401B1

(12) United States Patent
Krupp

(10) Patent No.: US 6,446,401 B1
(45) Date of Patent: Sep. 10, 2002

(54) KRUPP QUICK ROOF REMOVER TOOL AND METHOD

(76) Inventor: John J. Krupp, 1523 Lincoln St., Racine, WI (US) 53402

( * ) Notice: Subject to any disclaimer, the term of this patent is extended or adjusted under 35 U.S.C. 154(b) by 0 days.

(21) Appl. No.: 09/639,760

(22) Filed: Aug. 16, 2000

Related U.S. Application Data

(60) Provisional application No. 60/149,152, filed on Aug. 16, 1999.

(51) Int. Cl.[7] ..... E04D 15/00

(52) U.S. Cl. ..... 52/127.5; 52/DIG. 1; 52/749.12; 81/45; 254/131.5

(58) Field of Search ..... 52/127.5, 749.12, 52/DIG. 1, 741.1; 81/45; 254/131.5, 131

(56) References Cited

U.S. PATENT DOCUMENTS 3,604,518 A * 9/1971 Buchanan ..... 172/372
5,660,006 A * 8/1997 Emerson, Jr. ..... 52/127.2
6,055,789 A * 5/2000 Zimmerman ..... 52/749.1
6,070,498 A * 6/2000 Mislich et al. ..... 81/45
6,209,421 B1 * 4/2001 Thiele ..... 81/45

* cited by examiner

*Primary Examiner*—Carl D. Friedman
*Assistant Examiner*—Jennifer I. Thissell
(74) *Attorney, Agent, or Firm*—Jansson, Shupe & Munger, Ltd

(57) ABSTRACT

This invention is directed to a tool and a method for using a tool that is particularly useful to individuals engaged in the roofing and roof removal trades. The tool is configured in such a way as to make removal of a shingled roof much easier and with much less strain and effort on the part of the roof remover. The device provides for easy insertion of elongated arms under the shingles in the gap between the boards in the roof base and for a vertical engagement of shingle layers, which makes both inserting the device under the material to be removed and lifting of the layers much easier. After insertion of the device, the shingles are lifted until they are detached from the roof base or the handle of the device may be rotated to lift and disengage the roofing material from the roof base. Prior art devices used for similar tasks all involve horizontal engagement under the roof layers and a chiseling action to release the shingles which is less efficient and more stressful on the workman's body than the present invention.

11 Claims, 4 Drawing Sheets

KRUPP QUICK ROOF REMOVER TOOL AND METHOD

This invention is based on a provisional application filed on Aug. 16, 1999 and assigned Ser. No. 60/149,152 filed Aug. 16, 1999 entitled "Krupp Quick Roof Remover."

FIELD OF THE INVENTION

This invention is related generally to tools used by roofers, and, more particularly, to tools used by roofers in removing roofs from buildings having a base roofing material of wood shingles.

BACKGROUND OF THE INVENTION

Typically, a major task confronted by roofers when hired to install a new roof is the removal of the old roof. The removal of an existing roof before installing a new roof is sometimes desirable or required due to physical age and/or deterioration and leaking, or because of aesthetic reasons. Furthermore, locally enacted fire codes may require old roof removal before replacement where the weight of the existing roof is too great to safely sustain an additional layer on top of the existing roof.

One of the difficulties faced by roofers in the removal of an existing roof is that, in the case of roofs on older homes, there may be a layer of wood shingled roof under one or more layers of asphalt shingles, all of which must be removed before the new roofing material can be attached. Much of the roofing material to be removed is therefore not visible since it is covered by the more recent layers.

Furthermore, it is not necessarily immediately apparent to the roofer, in examining an old roof from the top layer, how many layers of shingles may exist at any one point on the roof and where each of those shingles may be attached by nails to the layer below it or to the roof base.

In a typical pre-1960's built home, the roof base consists of flat wooden boards placed horizontally and in parallel fashion side by side across the surface to be roofed, from the walls of the structure to the peak of the roof, with narrow gaps between the parallel boards. A roof at that time was constructed by fastening wooden shingles to the wooden base boards with nails and a hammer, working from the lower portion of the roof to the peak. In more recent years, the use of asphalt shingles has become more popular and these have been affixed directly on top of an existing shake roof.

The prior art provides no easy method for roof removal. The primary method used today requires hard manual work on the part of a roofer. Typically, the roofer removes the multiple layers of existing roof using brute force and body strength, assisted only by simple hand tools. These hand tools, such as pitchforks and spades, are tools that may be primarily designed for other applications, such as farming, although there are known to be spades made just for roofing. For example, there is a spade made for roofing with a pivot type of bracket to help lift off roofing, as well as a spade-like tool with a rachet type spade head to lift off shingles. Mallets and wood splitters have also been made for use in roof removal. Generally, power tools are not as effective for roof removal, although jack hammers have been known to be used for this purpose. Such tools are difficult and potentially hazardous when used in roof removal since the task is accomplished at potentially life-threatening heights, and a sloping and uneven roof surface provides less than sure footing for workmen. Furthermore, such power tools tend to be heavy, noisy and cause extreme vibration, which could also be hazardous to the workmen involved.

The hand tools available to a roofer to assist him in roof removal are generally pitchforks or spades. Such tools are forcefully inserted as far as possible in a horizontal direction parallel to, and under the edge of, the bottom surface of the roofing material. Often, nails are hit in the process because they are scattered throughout the roof and each layer of roof in somewhat unpredictable fashion since they are used to attach each shingle to the layer below. Repeatedly hitting nails, which is typical in the use of prior art hand tools in the task of roof removal, slows down the process of roof removal. It creates inefficiency and is jarring to the workman. When a nail is hit before the tool is fully inserted under the old roofing material, not as much surface area of the roof can be removed in each thrust of the tool. Hitting nails also requires a repositioning of the tool to avoid the nail and sometimes several thrusts must be made before the workman is able to position the tool in such a manner that he can fully load the tool with roofing material.

In the prior art method of roof removal, the tool is inserted under the roofing material and the material above the tool is loosened and lifted by the roofer by using brute strength and the weight of his body to lean forward on the handle of his tool and thereby force the material in an upwardly direction away from the surface of the roof base. Basically, roof removal is accomplished by repeatedly pushing the flat edge of the spade or pitchfork between the shingles and the roof, and engaging the shingles horizontally to loosen the roofing material from the surface of the roof base. In this manner, the roofing material is slowly chiseled off of the roof until all roofing material is removed. Such activity requires great strength on the part of the roofer. The repeated motion required and the jarring effect of repeatedly hitting nails under the old method and with the prior art tools used for roof removal is very stressful on the workman's body. All of these prior art tools and methods require a manner of use that results in repeated pounding and impact on the workman's wrists and elbows, creating an increased possibility of injury.

OBJECTS OF THE INVENTION

It is an object of this invention to provide a roof removal tool that is less physically stressful on the roofer's body than known tools presently in use.

Another object of this invention to provide a roof removal tool that requires less physical force to use than preexisting devices.

It is a further object of this invention to provide a roof removal tool that makes the task of roof removal more efficient and allows a roof to be removed in less time than is required with the use of existing tools.

Yet another object of this invention to provide a roof removal tool that is simple and inexpensive to manufacture.

It is an object of this invention to provide a roof removal tool that is uniquely designed and suited for the task for which it is used.

Another object of this invention is to provide a roof removal tool that is easy to transport to a job site and to safely use on a roof.

It is a further object of this invention to provide a design that will prevent the roofer from hitting nails in the old roof as the job of roof removal is accomplished.

Yet a further object of this invention is to provide a tool that engages the roofing material vertically and on both the top and bottom layers of the material, to provide better hold and leverage in removal of such layers.

Still another object of this invention is to provide a method for roof removal which is more efficient and which requires less physical force to accomplish than the method used in the prior art.

A further object of this invention is to provide a tool that can be used in engaging and lifting other material from a surface, such as patio blocks or bricks.

These and other important objects will be apparent from the following descriptions of this invention which follow.

SUMMARY OF THE INVENTION

The invention involves a device for lifting material from a surface, such device having a handle and a body. The body has an upper attachment length and a lower length. The upper attachment length is attached to the handle and the lower length has a lower length axis there through. The lower length is connected to an upper arm and a lower arm. The upper arm is connected to the lower length at an upper arm attachment site and the lower arm is connected to the lower length at a lower arm attachment site. There is a distance along the length of the lower length between the upper arm attachment site and the lower arm attachment site. The upper arm and the lower arm extend generally parallel to each other in a direction ninety degrees or greater from the lower length axis. One known way that the device can be used is where the material is shingles and the surface is a roof, although the device could be used in other lifting tasks as well.

In a preferred embodiment of the device, a reinforcing bar connects the upper arm with the lower arm of the device. The reinforcing bar may be generally perpendicular to the upper arm and the lower arm, but can be attached at other angles. The device can also be made with various arm lengths. However, the upper arm may be longer than the lower arm, particularly since the angle of use of the handle is toward the user. Ideally, both the upper arm and the lower arm are at least sixteen inches in length. For use on removal of shingles from a roof it is also preferred that the upper arm attachment site and the lower arm attachment site be at least two inches apart.

In one embodiment, the upper arm has an upper arm outer end and the lower arm has a lower arm outer end, and both the upper arm outer end and the lower arm outer end are pointed. Alternatively, the upper arm outer end and the lower arm outer end could be sharp-edged and wedge-shaped.

The invention also includes a method of removing shingles attached to a roof of parallel horizontal boards having a gap between the boards and having the steps of providing a device for lifting material from a roof base having a handle and a body, the body having an upper attachment length and a lower length, wherein the upper attachment length is attached to the handle and the lower length has a lower length axis there through and is connected to an upper arm and a lower arm. In the device, the upper arm is connected to the lower length at an upper arm attachment site and the lower arm is connected to the lower length at a lower arm attachment site. There is a distance between the upper arm attachment site and the lower arm attachment site along the length of the lower length. Additionally, the upper arm and the lower arm extend generally parallel to each other in a direction ninety degrees or greater from the lower length axis.

The device is used by inserting the lower arm into the gap; pushing the device forward until the shingles touch the lower length of the body; and lifting the device until the shingles are detached from the roof base boards. The method may also include the steps of rotating the handle in a forwardly direction to lift up the shingles, with greatest lift on the shingles closest to the workman until the shingles are fully detached from the roof; and lifting the removed shingles with the device and disposing of the shingles. This method may also be used with the additional step of rotating the handle in a backwardly direction toward the user to lift up on the shingles, with greatest lift on the shingles away from the workman. Such forwardly and backwardly rotation of the handle may be repeated until the shingles are completely disengaged from the roof base boards.

In a preferred method, the shingles have a bottom layer and a top layer and the device is in contact with both the bottom layer and the top layer at the same time during removal of the shingles. The method can also be described as a method wherein the shingles are removed from the roof with the device by vertical contact with the device. Preferably, the shingles during removal are between the upper arm and the lower arm and are held in place for lifting by the upper arm and lower arm of the device.

DETAILED DESCRIPTIONS OF THE PREFERRED EMBODIMENTS

Figure 1:
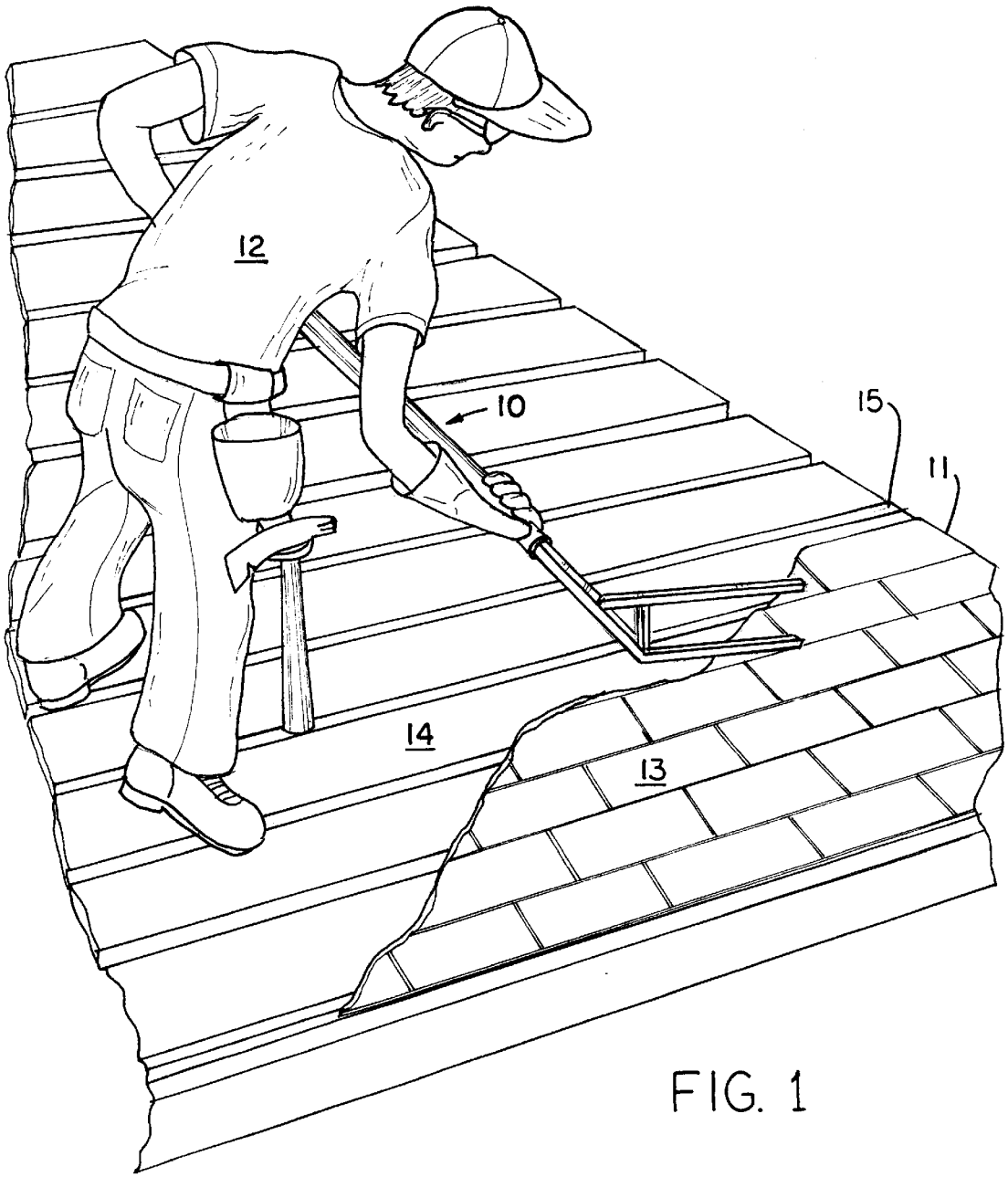
FIG. 1 perspective view of a roofer using the inventive device in roof removal, showing art of the roof broken away.
Figure 4:
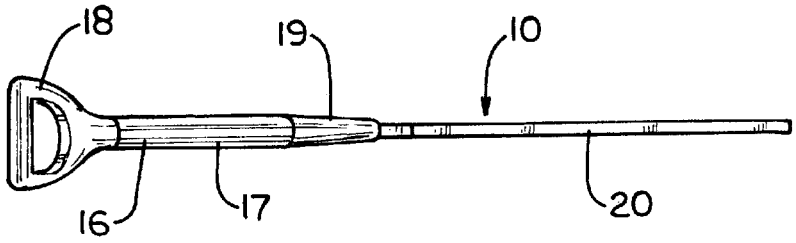
FIG. 4 is a view of the inventive device.

FIG. 1 shows the new inventive device 10 in use on a typical roof 11 as used by a workman 12 removing the roofing shingles 13 from the roof base boards 14. FIG. 1 shows a roof having gaps 15 between the roof base boards 14, which is typical of a pre-1960's built home. With such older homes, the roof base boards 14 are flat wooden boards placed horizontally and parallel to one another side by side across the surface roofed, from the walls of the house up to the peak of the roof, with narrow gaps 15 between the parallel roof base boards 14. Roofs 11 at that time were constructed by fastening wooden shingles 13 to the roof base boards 14 with nails and a hammer, working from the lower portion of the roof 11 to the peak. In more recent years, the use of asphalt shingles 13 has become popular and oftentimes asphalt shingles 13 have been affixed in multiple layers on top of an existing layer of wood shingles 13.

Figure 2:
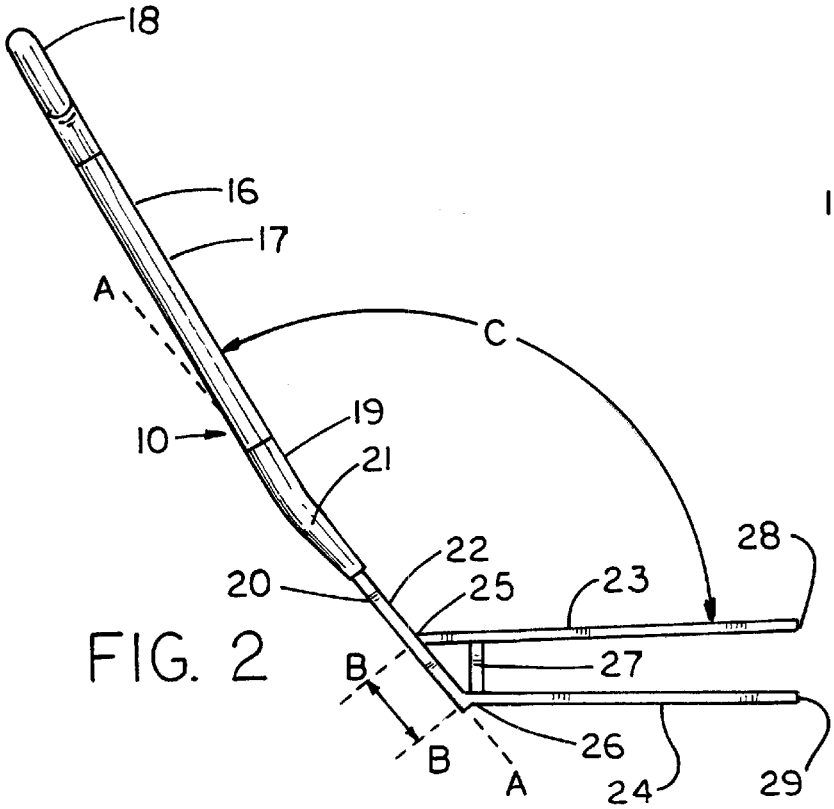
FIG. 2 is a side view of the inventive device showing the upper attachment axis A—A there through, distance B—B and angle C.
Figure 3:
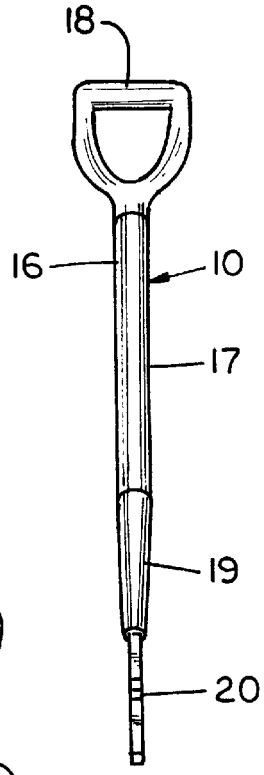
FIG. 3 is front view of the inventive device.
Figure 5:
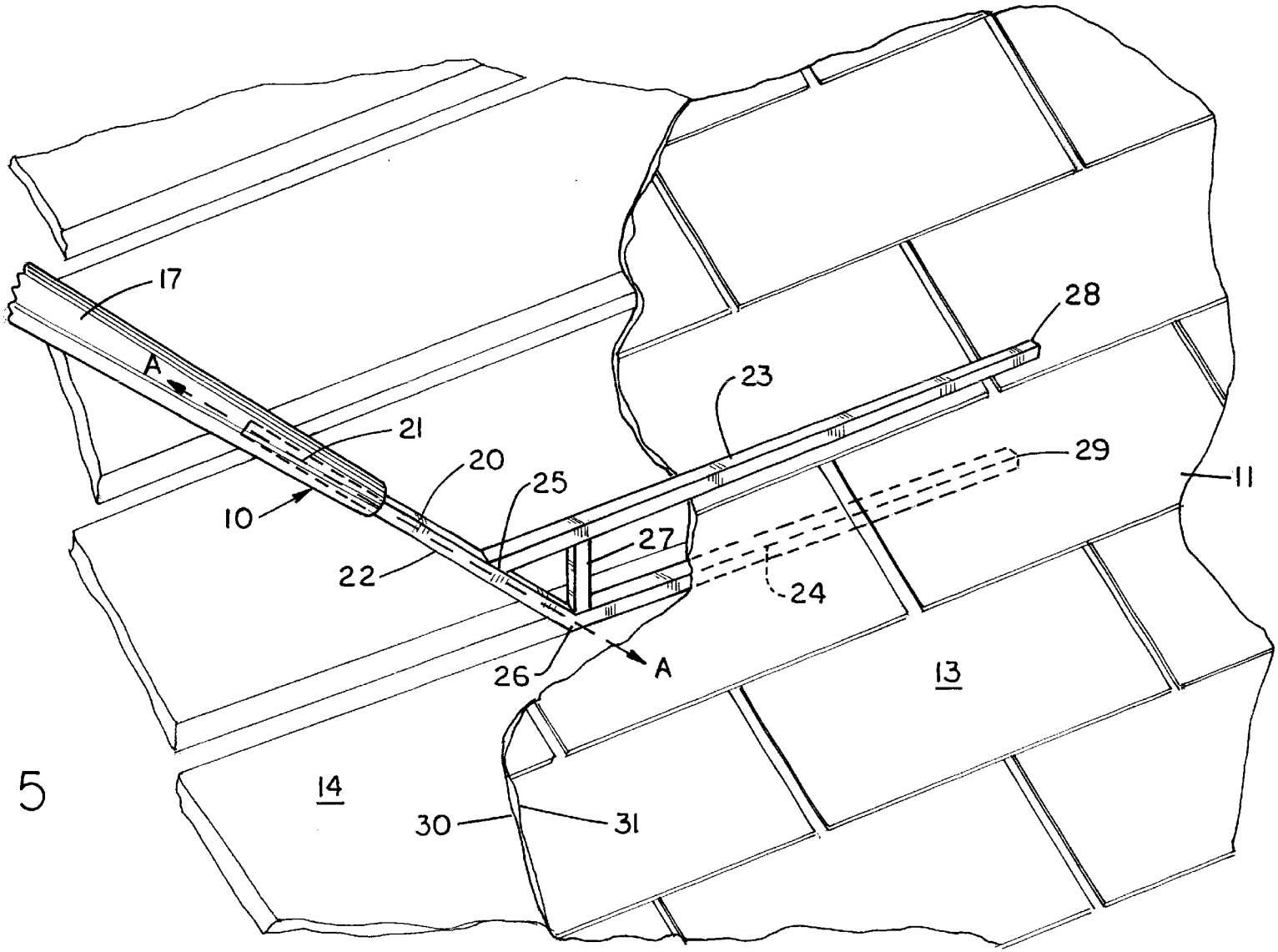
FIG. 5 is a perspective view of the inventive device in use on a roof, with parts of the device and the roof broken away, showing the lower arm of the device in phantom lines in the gap beneath the shingles on the roof.

Turning to FIGS. 1, 2 and 3, the device 10 is shown in side, front and top views, respectively. The device 10 has a handle 16, which could be specially made or may be a typical standard shovel handle, having a good grasping means and manufactured with sufficient strength to allow stress on the handle 16 without deformation. A typical handle 16 would include a shaft 17, typically made of wood, a plastic or steel end for grasping 18, and a tool attachment shaft 19, typically made of steel, to which the body 20 of the device 10 can be attached, preferably by welding, although other means of attachment would be possible.

As shown in FIG. 2, the body 20 has an upper attachment length 21 and a lower length 22. The upper attachment length 21 is inserted in the tool attachment shaft 19 of the handle 16 and welded or otherwise affixed in place within the tool attachment shaft 19. The lower length 22 has a lower length axis A—A, shown in FIG. 2 and is connected to an upper arm 23 and a lower arm 24. The upper arm 23 is connected to the lower length 22 at the upper arm attachment site 25 and the lower arm 24 is connected to the lower length 22 at the lower arm attachment site 26.

In a preferred embodiment, the upper arm 23 and the lower arm 24 are connected to the lower length 22 of the body 20 by welding, but other means of attachment such as screws are a possible alternative. Preferably, there is some distance B—B between the upper arm attachment site 25 and the lower arm attachment site 26. Although the distance B—B can vary, and it has been found that the device 10 is most effective when the distance B—B (from the midpoint of the upper arm 23 to the midpoint of the lower arm 24) is at least two inches, although a distance of four inches is preferable when angle C (described below) is 130 degrees. Such a distance allows for an approximate perpendicular distance between the parallel upper arm 23 and the lower arm 24 of two and one half inches. This measurement provides enough distance between the upper arm 23 and the lower arm 24 to enable several layers of shingles 13 to be cradled between the upper arm 23 and the lower arm 24 as they are loosened from the roof 11.

It should be noted that the device 10 could also be useful in assisting a workman 12 engaged in other lifting and removal tasks, such as the lifting of patio blocks or bricks from a surface. The distance B—B could be varied to particularly adapt the device 10 to the particular task and type of material desired to be lifted, as well as the angle C (described below) between the lower length axis A—A and the upper arm 23 and lower arm 24.

Preferably, the upper arm 23 and the lower arm 24 extend generally parallel to one another in a direction that forms an angle C with the lower length axis A—A that is ninety degrees or greater. The preferred embodiment has an angle C of 130 degrees which provides a good working angle for effectively using the device 10 in the removal of shingles 13 from a roof 11.

In a preferred embodiment, the device 10 has a reinforcing bar 27 which connects the upper arm 23 and the lower arm 24. This reinforcing bar 27 adds further strength to the device 10. It is located close to the lower length 22 of the body 20 so as not to interfere with the ability of the device 10 to cradle shingles 13 between the upper arm 23 and the lower arm 24 and is generally perpendicular to the upper arm 23 and the lower arm 24.

The upper arm 23 may be longer than the lower arm 24, particularly to accommodate the angle C between the lower length 22 and the upper arm 23 and lower arm 24. In fact, in the preferred embodiment, the angle C is approximately 130 degrees, which requires the upper arm 23 to be longer than the lower arm 24 in order for the upper arm 23 and the lower arm 24 to terminate in the same plane perpendicular to the parallel upper arm 23 and lower arm 24. Preferably, the upper arm 23 and lower arm 24 are both at least sixteen inches in length.

The body 20, as well as the upper arm 23, the lower arm 24, and the reinforcing bar 27 should be made from a material that can withstand repeated force and pressure such as ½ inch hardened steel bars. Such material could be square or circular in cross-section, although the preferred embodiment is made of ½ inch square hardened steel bars, since a flat surface may more easily be inserted in the gap 15 under the shingles 13 to be removed. In the preferred embodiment, the body 20 is welded to the handle 16, the upper arm 23 and the lower arm 24 are welded to the lower length 22 of the body 20, and the reinforcing bar 27 is welded to the upper arm 23 and the lower arm 24, although alternative means of attachment are possible which could accomplish the same objective.

Figure 6:
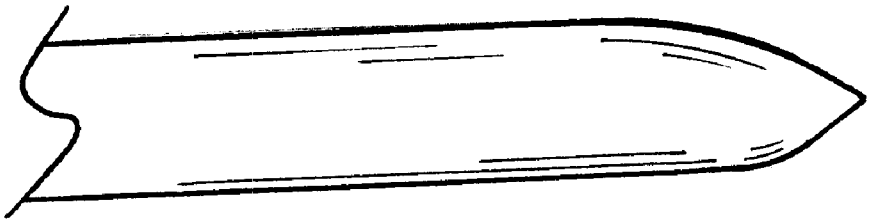
FIGS. 6 and 7 are enlarged fragmentary perspective views of arm ends which are sharp-edged and wedge-shaped, respectively.
Figure 7:
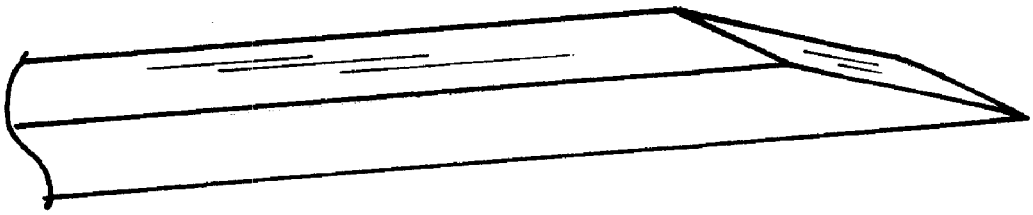

Alternative embodiments are also included in the invention which could be particularly advantageous depending upon the task at hand. For example, the upper arm 23 has an upper arm outer end 28 and the lower arm 24 has a lower arm outer end 29. Both the upper arm outer end 28 and the lower arm outer end 29 could be pointed, or alternatively, could be sharp-edged and wedge-shaped, or, only the lower arm 24 could be pointed or sharp-edged and wedge-shaped, which could be beneficial in pushing the lower arm 24 under the shingles 13 or other material intended to be lifted. Sharp-edged and wedge-shaped configurations are illustrated in FIGS. 6 and 7, respectively.

The invention also includes a method of removing shingles 13 attached to a roof 11 of parallel roof base boards 14 having a gap 15 between the roof base boards 14. The method provides the device 10 as previously discussed, which is a device 10 for lifting shingles 13 from the roof base boards 14. The device 10 has a handle 16 and a body 20, both in the form and alternative embodiments previously discussed. The method includes the steps of providing the device 10, inserting the lower arm 24 into the gap 15, pushing the device 10 forward until the shingles 13 touch the lower length 22 of the body 20, and lifting the device 10 until the shingles 13 are detached from the roof base boards 14. Because the device 10 is designed to fit into the gap 15 between the roof base boards 14, it slips in and under the shingles 13 easily and without the need for exerting excessive force or pounding as required of the prior art tools. The method can also include the additional steps of rotating the handle 16 in a forwardly direction to lift up the shingles 13,with greatest lift on the shingles 13 closest to the workman 12 until the shingles 13 are fully detached from the roof base boards 14; and lifting the removed shingles 13 with the device 10 and disposing of the shingles 13.

The method can also include the additional step of rotating the handle 16 in a backwardly direction toward the workman 12 to further lift up the shingles 13 from the roof base boards 14 with the greatest lift on the shingles 13 away from the workman 12 and repeating such forwardly and backwardly rotation of the handle 16 until the shingles 13 are completely disengaged from the roof base boards 14.

The method can also be used wherein there are multiple layers of shingles 13 having a bottom layer 30 and a top layer 31. Preferably, although it is not a requirement for the device 10 to function in its intended manner, the device 10 may be in contact with the bottom layer 30 and the top layer 31 at the same time and will cradle the multiple layers 30 and 31 between the upper arm 23 and the lower arm 24. Such cradling involves a vertical contact with the shingles 13 which makes removal easier and more efficient. In fact, the shingles 13 may actually be held in place for lifting by the cradling effect of the upper arm 23 and the lower arm 24 of the device 10.

Most devices of the prior art involve a horizontal contact between a tool surface and the bottom layer 30 of the shingles 13, resulting in more friction between the device 10, the shingles 13 and the roof base boards 14. Such tools therefore require more force to be exerted by the workman 12 to remove the shingles 13 than the force required to use the device 10 to accomplish the same purpose. The inventive method described herein results in greater efficiency and less stress on the body of the workman 12 because of the unique and inventive design of the device 10.

It should be noted also that multiple devices 10 could be used at the same time on a roof 11 by multiple workmen 12, which would further diminish the time required to complete the task of roof removal.

While the principles of this invention have been described in connection with specific embodiments, it should be understood clearly that these descriptions are made only by way of example and are not intended to limit the scope of the invention.

What is claimed is:

1. A method for a workman to remove shingles attached to a roof of parallel horizontal roof base boards having a gap between the roof base boards, comprising:

providing a device for lifting material from the roof base boards, the device including a handle and a body including an upper attachment length connected to the handle and a lower length which has a lower-length axis therethrough and is connected to upper and lower arms, the upper arm being connected to the lower length at an upper-arm attachment site and the lower arm being connected to the lower length at a lower-arm attachment site spaced from the upper-arm attachment site, the upper and lower arms extending substantially parallel to each other in a direction at least ninety degrees from the lower length axis;

inserting the lower arm into the gap;

pushing the device forward until the shingles touch the lower length of the body; and lifting the device until the shingles are detached from the roof base boards.

2. The method of claim 1 wherein the handle is rotated in a forwardly direction to lift up the shingles, with greatest lift on the shingles from the roof base boards closest to the workman until the shingles are fully detached from the roof base boards; and lifting the removed shingles with the device and disposing of the shingles.

3. The method of claim 2 with the additional step, after rotating the handle in a forward direction, of rotating the handle in a backward direction toward the workman to further lift up the shingles from the roof base boards with greatest lift on the shingles away from the workman, and repeating such forward and backward rotations of the handle until the shingles are completely disengaged from the roof base boards.

4. The method of claim 1 wherein the shingles have a bottom layer and a top layer, and wherein the device is in contact with both the bottom layer and the top layer at the same time.

5. The method of claim 1 wherein the shingles are removed from the roof with the device by vertical contact with the device.

6. The method of claim 1 wherein the shingles during removal are between the upper arm and the lower arm and are held in place for lifting by the upper arm and the lower arm of the device.

7. A tool for removing from a roof shingles attached to roof base boards having gaps therebetween, comprising:

a handle; and a body including an upper attachment length connected to the handle and a lower length which has a lower-length axis therethrough and is connected to upper and lower arms, the upper arm being connected to the lower length at an upper-arm attachment site and the lower arm being connected to the lower length at a lower-arm attachment site spaced from the upper-arm attachment site, the upper and lower arms extending substantially parallel to each other in a direction at least ninety degrees from the lower length axis and having an open-ended shingle-receiving gap therebetween.

8. The device of claim 7 wherein a reinforcing bar connects the upper arm and the lower arm.

9. The device of claim 8 wherein the reinforcing bar is substantially perpendicular to the upper arm and the lower arm.

10. The device of claim 7 wherein the upper arm is longer than the lower arm.

11. The device of claim 7 wherein the upper-arm and lower-arm attachment sites are at least two inches apart.

* * * * *